US009664471B1

(12) United States Patent
Curry et al.

(10) Patent No.: US 9,664,471 B1
(45) Date of Patent: May 30, 2017

(54) FIREARM END CAP

(71) Applicant: Smith & Wesson Corp., Springfield, MA (US)

(72) Inventors: Brett Curry, Monson, MA (US); Sean O'Clair, Feeding Hills, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/146,954

(22) Filed: May 5, 2016

(51) Int. Cl.

| | |
|---|---|
| ***F41A 3/00*** | (2006.01) |
| ***F41A 19/30*** | (2006.01) |
| ***F41C 3/00*** | (2006.01) |
| ***F41C 27/00*** | (2006.01) |
| ***F41A 3/72*** | (2006.01) |

(52) U.S. Cl.
CPC ..... *F41A 19/30* (2013.01); *F41A 3/72* (2013.01); *F41C 3/00* (2013.01); *F41C 27/00* (2013.01)

(58) Field of Classification Search
CPC .. F41A 19/30; F41A 3/72; F41A 19/34; F41A 19/35; F41A 19/37; F41A 19/38; F41A 19/40; F41C 3/00; F41C 27/00; F41G 1/10; Y10T 29/49963; Y10T 29/49826
USPC ..... 42/69.02
See application file for complete search history.

(56) References Cited

U.S. PATENT DOCUMENTS

| | | | | |
|---|---|---|---|---|
| 1,680,186 | A | 8/1928 | von Frommer | |
| 6,338,217 | B1 * | 1/2002 | Viani | F41A 17/02 42/70.08 |
| 6,357,155 | B1 | 3/2002 | Amadini | |
| 6,363,646 | B1 * | 4/2002 | Amadini | F41A 17/02 42/70.08 |
| 6,510,641 | B1 * | 1/2003 | Viani | F41A 17/02 42/70.08 |
| 7,509,766 | B2 * | 3/2009 | Vasquez | F41A 19/01 42/1.01 |
| 8,191,301 | B2 * | 6/2012 | Hatfield | F41A 19/34 42/90 |
| 8,468,734 | B2 * | 6/2013 | Meller | F41A 3/72 42/71.02 |
| 8,528,242 | B2 * | 9/2013 | Green | F41A 17/64 42/70.08 |
| 8,959,819 | B2 * | 2/2015 | Jones | F41A 17/64 42/70.08 |
| 8,997,391 | B2 * | 4/2015 | Rozic | F41G 1/02 42/111 |
| 9,015,912 | B2 | 4/2015 | Nanbu et al. | |
| 9,194,654 | B1 * | 11/2015 | Viani | F41C 27/00 |
| 9,285,186 | B1 * | 3/2016 | Di Veroli | F41G 1/06 |
| 9,291,413 | B1 * | 3/2016 | Viani | F41C 27/00 |
| 9,328,991 | B2 * | 5/2016 | Gale | F41C 27/00 |
| D761,374 | S * | 7/2016 | Ellsworth | D22/108 |

(Continued)

*Primary Examiner* — Michelle R Clement
(74) *Attorney, Agent, or Firm* — John A. Chionchio, Esquire; Ballard Spahr LLP

(57) ABSTRACT

An end cap for a semiautomatic pistol is mounted at the breech end of a slide to maintain the striker assembly in place when subject to inertial loads. The end cap includes a body with a base and a cover. A metal plate is mounted between the base and cover to prevent striker blow-out in the event that a primer is pierced. Flexible, resilient projections extend from the base and engage the slide within a recess, the projections extending transversely to the firing axis to counter inertial forces that might otherwise dislodge the end cap and cause a stoppage.

33 Claims, 3 Drawing Sheets

(56) References Cited

U.S. PATENT DOCUMENTS

| | | | | |
|---|---|---|---|---|
| 2001/0037596 | A1* | 11/2001 | salvitti | F41A 17/64 42/70.08 |
| 2004/0200109 | A1* | 10/2004 | Vasquez | F41A 19/01 42/1.01 |
| 2011/0154710 | A1* | 6/2011 | Hatfield | F41A 19/34 42/90 |
| 2011/0252686 | A1* | 10/2011 | Coleman | F41A 15/10 42/25 |
| 2012/0198744 | A1* | 8/2012 | Meller | F41A 3/72 42/90 |
| 2013/0000173 | A1* | 1/2013 | Green | F41A 17/64 42/70.11 |
| 2014/0101981 | A1* | 4/2014 | Jones | F41A 17/64 42/70.06 |
| 2014/0298703 | A1* | 10/2014 | Gale | F41C 27/00 42/71.02 |
| 2015/0184966 | A1* | 7/2015 | Beck | F41A 17/64 42/70.08 |
| 2015/0233663 | A1* | 8/2015 | Kiehn | F41C 33/001 42/90 |

* cited by examiner

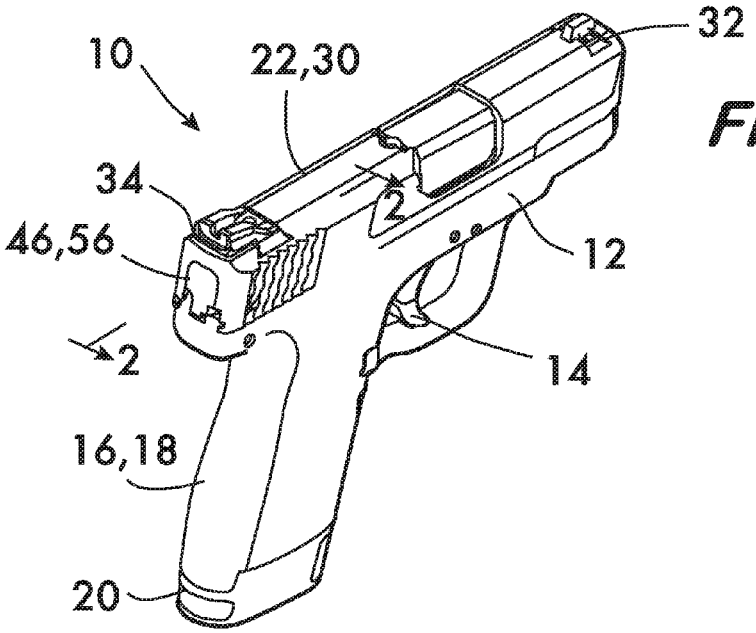
FIG. 1
FIG. 2
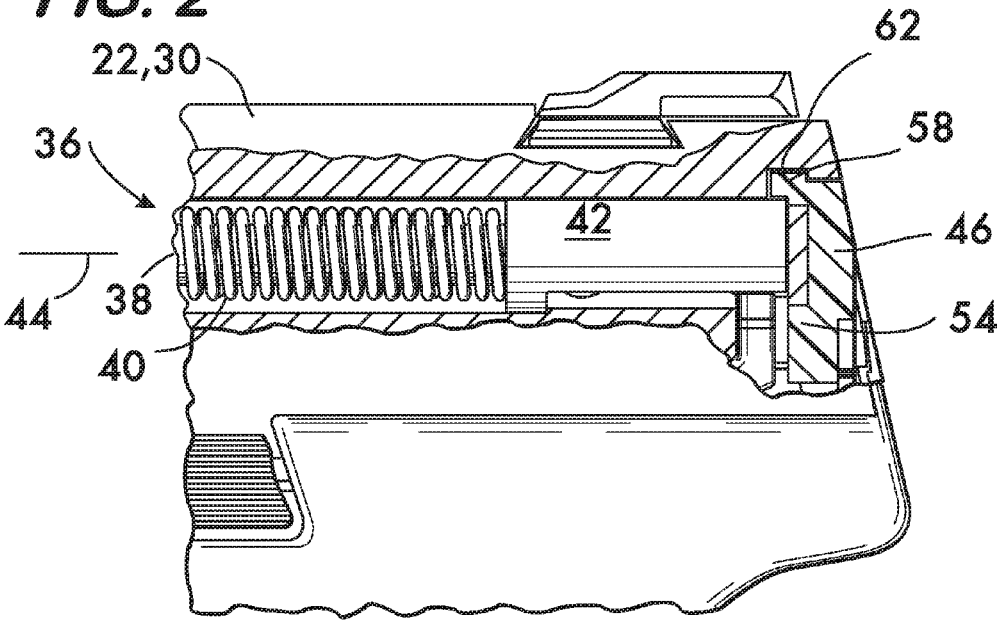

FIREARM END CAP

FIELD OF THE INVENTION

This invention relates to firearms such as striker fired semiautomatic pistols having slides with end caps for retaining the striker assembly.

BACKGROUND

Striker fired semiautomatic pistols have a striker assembly positioned within the slide of the pistol. The striker assembly may comprise a striker, a striker spring and a striker bushing. The spring acts between the striker and the bushing to propel the striker against the primer of a chambered cartridge to fire the cartridge when the pistol's trigger is pulled. The spring also serves to bias the bushing against the end cap of the slide. The end cap retains the striker assembly within the slide and is a separate piece which bears against the end of the slide. The end cap is said to "float" between the bushing and the end of the slide. In some pistols it is the biasing force of the compressed spring which maintains the striker assembly positioned within the slide. In other pistols the biasing force is provided by an extractor spring through a transfer bar.

Lightweight prior art pistols which rely on spring biasing to maintain the striker assembly compressed against a floating end cap are at a disadvantage when firing large caliber, powerful rounds. The recoil upon firing may subject the pistol to inertial forces which overcome the biasing force of the striker spring (or the extractor spring) against the end cap. This can cause the end cap to come out of position, which may result in a stoppage of the pistol. It would be advantageous to secure the striker assembly without relying solely on the biasing force of a spring subject to inertial loads.

SUMMARY

The invention concerns an end cap positionable within a slide of a firearm for retaining a striker and a striker bushing within the slide. The striker has a longitudinal axis. In one example embodiment the end cap comprises a body having a surface engageable with the striker bushing. At least a first projection extends from the body transversely to the longitudinal axis of the striker. The first projection is engageable within a recess in the slide. In one example embodiment the first projection comprises a first strip extending outwardly from the body. In a particular example, the first strip is curved. By way of example, the first strip has first and second ends attached to the body. In an example embodiment, the first projection is resiliently flexible. Another example embodiment further comprises a second projection extending from the body transversely to the longitudinal axis of the striker. By way of example, the first projection is positioned on a first side of the body and the second projection is positioned on a second side of the body opposite to the first. Further by way of example, the second projection comprises a second strip extending outwardly from the body. In a particular example, the second strip is curved. Additionally by way of example, the second strip has first and second ends attached to the body. In an example embodiment the second projection is resiliently flexible.

The end cap according to an example embodiment further comprises a metal plate positioned adjacent to the first projection. In this example the metal plate comprises the surface engageable with the striker bushing. In a specific example embodiment the end cap comprises a base, the first projection being mounted on the base, and a cover positioned in spaced relation to the base, the metal plate being positioned between the base and the cover.

The invention further includes a slide for a firearm adapted to receive a striker and a striker bushing. The striker has a longitudinal axis. In an example embodiment the slide comprises first and second sidewalls connected by a back wall and defining a channel having a muzzle end and a breech end oppositely disposed. A recess is positioned within the channel proximate to the breech end. An end cap is positioned at the breech end and comprises a body having a surface engageable with the striker bushing. In this example at least a first projection extends from the body transversely to the longitudinal axis of the striker. The first projection is received within the recess.

In a particular example embodiment the first projection comprises a first strip extending outwardly from the body. By way of example the first strip is curved. Additionally by way of example the first strip has first and second ends attached to the body. In an example embodiment the first projection is resiliently flexible.

Additionally by way of example a second projection extends from the body transversely to the longitudinal axis of the striker. The second projection is received within the recess in this example. In an example embodiment the first projection is positioned on a first side of the body and the second projection is positioned on a second side of the body opposite to the first. In a particular example embodiment the second projection comprises a second strip extending outwardly from the body. By way of example the second strip is curved. Further by way of example the second strip has first and second ends attached to the body. By way of example the second projection is resiliently flexible.

An example embodiment further comprises a metal plate positioned adjacent to the first projection. The metal plate comprises the surface engageable with the striker bushing in this example. Additionally by way of example, the end cap further comprises a base. The first projection is mounted on the base in an example embodiment. A cover is positioned in spaced relation to the base, the metal plate being positioned between the base and the cover in an example embodiment.

The invention further encompasses a pistol. In an example embodiment of the invention the pistol comprises a frame. A slide is mounted on the frame. The slide comprises first and second sidewalls connected by a back wall and defining a channel having a muzzle and a breech end oppositely disposed. A striker and a striker bushing are positioned within the channel. The striker has a longitudinal axis. In an example embodiment a recess is positioned within the channel proximate to the breech end. An end cap is positioned at the breech end and, in an example embodiment comprises a body having a surface engageable with the striker bushing. At least a first projection extends from the body transversely to the longitudinal axis of the striker in an example embodiment. The first projection is received within the recess.

In a specific example embodiment the first projection comprises a first strip extending outwardly from the body. By way of example, the first strip is curved. Additionally by way of example, the first strip has first and second ends attached to the body. The first projection is resiliently flexible. Another example embodiment further comprises a second projection extending from the body transversely to the longitudinal axis of the striker. The second projection is received within the recess. In an example embodiment the first projection is positioned on a first side of the body and the second projection is positioned on a second side of the body opposite to the first.

By way of example, the second projection comprises a second strip extending outwardly from the body. Further by way of example the second strip is curved. In a particular example embodiment the second strip has first and second ends attached to the body. By way of example the second projection is resiliently flexible.

An example embodiment further comprises a metal plate positioned adjacent to the first projection. The metal plate comprises the surface engageable with the striker bushing in this example.

Further by way of example the end cap comprises a base. The first projection is mounted on the base in this example. A cover is positioned in spaced relation to the base. The metal plate is positioned between the base and the cover in this example.

BRIEF DESCRIPTION OF THE DRAWINGS

FIG. 1 is an isometric view of an example pistol according to the invention;

FIG. 2 is a sectional view taken at line 2-2 of FIG. 1;

DETAILED DESCRIPTION

Figure 5:
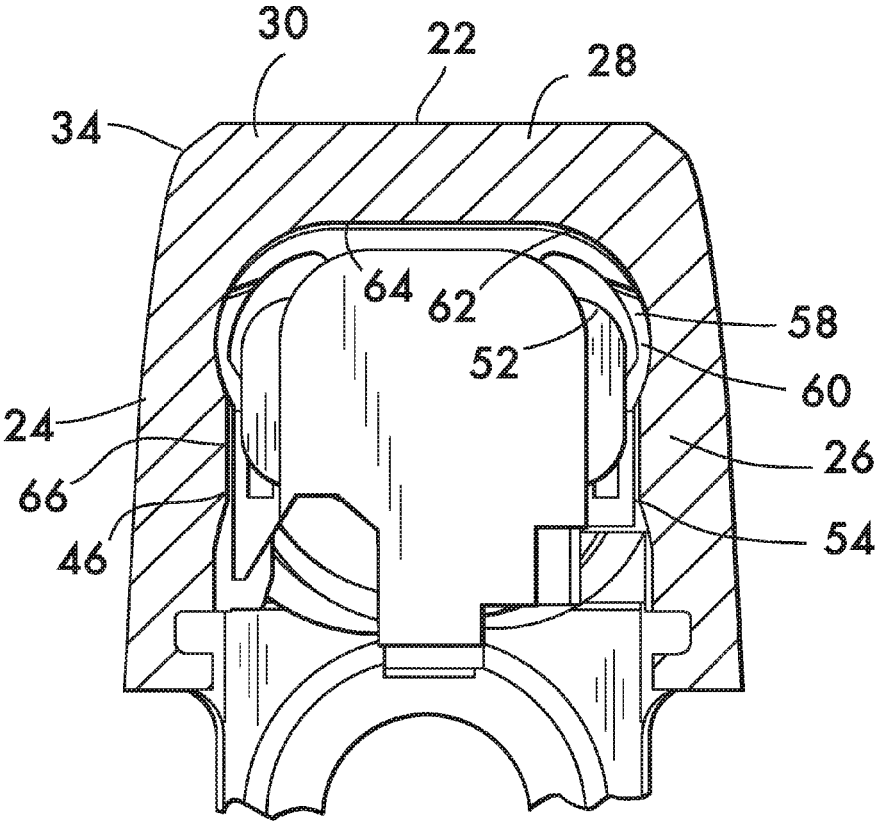
FIG. 5 is a partial sectional view of the end cap taken through the breech end of the slide in FIG. 1.

FIG. 1 shows an example pistol 10 according to the invention. Pistol 10 comprises a frame 12 in which a trigger mechanism 14 is housed. Frame 12 also includes a grip 16 which defines a magazine well 18 which receives an ammunition magazine 20. A slide 22 is mounted on frame 12. As shown in FIG. 5, slide 22 comprises first and second sidewalls 24 and 26 connected by a back wall 28 and defining a channel 30. As shown in FIG. 1, channel 30 has a muzzle end 32 and an oppositely disposed breech end 34. As shown in FIG. 2, a striker assembly 36 comprising a striker 38, a striker spring 40 and a striker bushing 42 is positioned within channel 30. Striker 38 has a longitudinal axis 44 that aligns with the firing axis of pistol 10.

Figure 3:
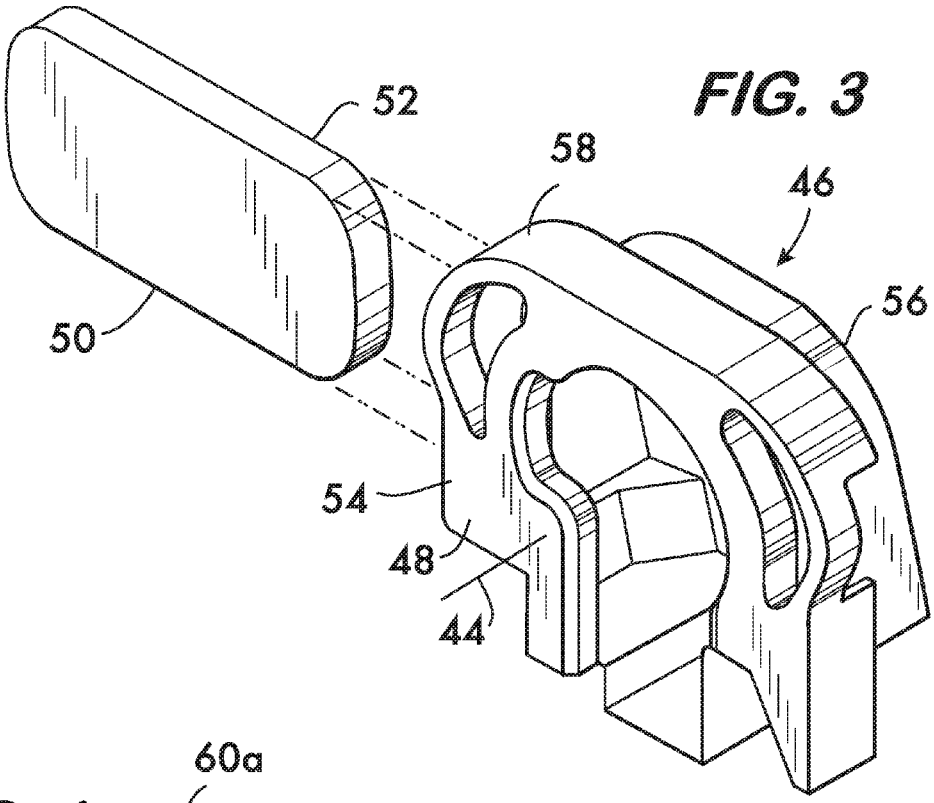
FIG. 3 is an exploded isometric view of an example end cap according to the invention.
Figure 4:
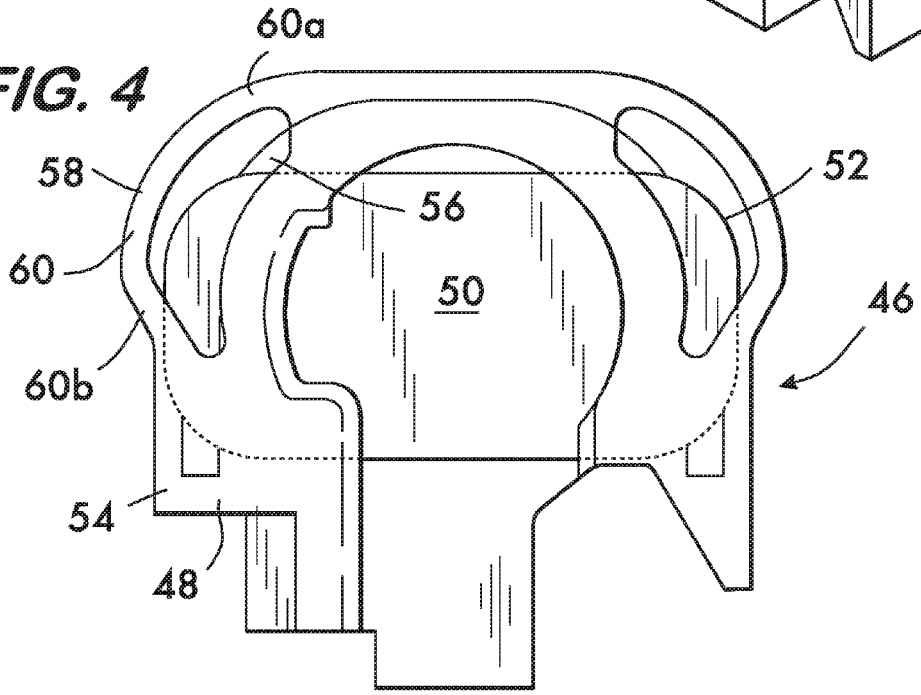
FIG. 4 is an elevational view of the example end cap shown in FIG. 3.

Striker assembly 36 is captured within channel 30 by an end cap 46. FIGS. 3 and 4 show an example end cap 46 according to the invention. Example end cap 46 is positioned at the breech end 34 of slide 22 (see also FIG. 1) and comprises a body 48 having a surface 50 engageable with the striker bushing 42. Surface 50 serves as the reaction surface against which the bushing reacts when biased by striker spring 40 (see FIG. 2). Surface 50 is advantageously the surface of a metal plate 52 mounted on the body 48, the body being formed of a polymer in this example. Metal plate 52 is advantageous should the striker 38 pierce the primer of a cartridge being fired. A pierced primer might allow the expanding gasses of the propellant charge to vent against the striker rather than the bullet, and the metal plate 52 will prevent the striker assembly 36 from blowing out through the breech end 34 of the slide 22.

In the example embodiment shown in FIGS. 3 and 4, body 48 comprises a base 54 and a cover 56 attached to the base in spaced relation. Plate 52 is positioned between the base 54 and cover 56 and the assembly comprising body 48 and plate 52 shown in FIG. 4 may be formed, for example, in a co-molding operation. Cover 56 is visible at the breech end 34 of the slide 22 (see FIG. 1), and as shown in FIG. 2, base 54 is positioned within the slide 22 and functions to secure the end cap 46 to the slide through the mechanical interaction between one or more projections and the slide. With reference again to FIGS. 3 and 4, at least a first projection 58 extends from the body 48, in this example, from the base 54. Projection 58 extends transversely to the striker axis 44 and comprises a first strip 60 extending outwardly from base 54. Strip 60 is curved in this example and has first and second ends 60*a* and 60*b* attached to the base 54. The projection 58 is resiliently flexible which is advantageous for assembly of the end cap 46 into the slide 22 as described below. The flexible, resilient characteristics of the projection 58 may be realized in various ways, for example, by forming the body 48 from a flexible, resilient polymer and by controlling the cross sectional area moment of inertia of strips 60 forming the projection. As shown in the example of FIG. 4, two projections 58 are positioned on opposite sides of body 48, the second projection being a mirror image of the first projection.

FIGS. 2 and 5 illustrate the mechanical interaction between the projections 58 of body 48 and the slide 22 which maintains the end cap 46 engaged with the slide. The base 54 and its projections 58 are received within a recess 62 positioned within the channel 30 proximate to the breech end 34 of the slide 22. As shown in cross section in FIG. 5, the recess 62 is defined by an inwardly facing surface 64 which has a shape that is substantially matched to the outer shape of the projections 58. As shown in both FIGS. 4 and 5, the outwardly extending strips 60 give the base 54 to which the strips are attached a bulbous shape. The end cap 46 is thus retained within the recess 62 by the interaction between the outwardly extending projections 58 and the inwardly facing surface 64 which defines the recess. However, due to the resilient, flexible nature of the projections it is possible to insert and remove the end cap 46 into the recess 62. Upon insertion, for example, the projections 58 deform toward one another as they encounter the narrow mouth 66 of the recess 66. Once they are past this mouth the resilient projections 58 spring back to their undeformed shape as shown in FIG. 5, thereby filling the recess 62 and engaging with the surface 64. Removal is accomplished by drawing the end cap 46 from the recess 62, whereupon interaction between the surface 64 and the flexible, resilient projections 58 cause the projections to deform and pass through the mouth 66 of the recess 62.

The fact that the projection or projections 58 extend transversely to the longitudinal axis of the striker 38 (which is aligned with the firing axis) and are captured within the recess 62 allows the end cap 46 to effectively resist the inertial forces normally encountered along the striker/firing axis during firing of the pistol 10. Hence a potential source for malfunction is significantly reduced because the various components of the striker assembly 36 and the end cap 46 will remain securely in place even when large caliber cartridges are fired from relatively lightweight pistols when an end cap according to the invention is used.

What is claimed is:

1. An end cap positionable within a slide of a firearm for retaining a striker and a striker bushing within said slide, said striker having a longitudinal axis, said end cap comprising:

a body having a surface engageable with said striker bushing;

at least a first strip extending from said body transversely to said longitudinal axis, said first strip having first and second ends attached to said body and being engageable within a recess in said slide.

2. The end cap according to claim 1, wherein said first strip is curved.

3. The end cap according to claim 1, wherein said first strip is resiliently flexible.

4. The end cap according to claim 1, further comprising a projection extending from said body transversely to said longitudinal axis.

5. The end cap according to claim 4, wherein said first strip is positioned on a first side of said body and said projection is positioned on a second side of said body opposite to said first.

6. The end cap according to claim 4, wherein said projection comprises a second strip extending outwardly from said body.

7. The end cap according to claim 6, wherein said second strip is curved.

8. The end cap according to claim 6, wherein said second strip has first and second ends attached to said body.

9. The end cap according to claim 4, wherein said projection is resiliently flexible.

10. The end cap according to claim 1, further comprising a metal plate positioned adjacent to said first strip, said metal plate comprising said surface engageable with said striker bushing.

11. The end cap according to claim 10, wherein said end cap comprises:

a base, said first strip being mounted on said base;

a cover positioned in spaced relation to said base, said metal plate being positioned between said base and said cover.

12. A slide for a firearm adapted to receive a striker and a striker bushing, said striker having a longitudinal axis, said slide comprising:

first and second sidewalls connected by a back wall and defining a channel having a muzzle end and a breech end oppositely disposed;

a recess positioned within said channel proximate to said breech end;

an end cap positioned at said breech end and comprising a body having a surface engageable with said striker bushing;

at least a first strip extending from said body transversely to said longitudinal axis, said first strip having first and second ends attached to said body, said first strip being received within said recess.

13. The slide according to claim 12, wherein said first strip is curved.

14. The slide according to claim 12, wherein said first strip is resiliently flexible.

15. The slide according to claim 12, further comprising a projection extending from said body transversely to said longitudinal axis, said projection being received within said recess.

16. The slide according to claim 15, wherein said first strip is positioned on a first side of said body and said projection is positioned on a second side of said body opposite to said first.

17. The slide according to claim 15, wherein said projection comprises a second strip extending outwardly from said body.

18. The slide according to claim 17, wherein said second strip is curved.

19. The slide according to claim 17, wherein said second strip has first and second ends attached to said body.

20. The slide according to claim 15, wherein said projection is resiliently flexible.

21. The slide according to claim 12, further comprising a metal plate positioned adjacent to said first strip, said metal plate comprising said surface engageable with said striker bushing.

22. The slide according to claim 21, wherein said end cap further comprises:

a base, said first strip being mounted on said base;

a cover positioned in spaced relation to said base, said metal plate being positioned between said base and said cover.

23. A pistol, comprising:

a frame;

a slide mounted on said frame, said slide comprising:

first and second sidewalls connected by a back wall and defining a channel having a muzzle and a breech end oppositely disposed;

a striker and a striker bushing positioned within said channel, said striker having a longitudinal axis;

a recess positioned within said channel proximate to said breech end;

an end cap positioned at said breech end and comprising a body having a surface engageable with said striker bushing;

at least a first strip extending from said body transversely to said longitudinal axis, said first strip having first and second ends attached to said body and being received within said recess.

24. The pistol according to claim 23, wherein said first strip is curved.

25. The pistol according to claim 23, wherein said first strip is resiliently flexible.

26. The pistol according to claim 23, further comprising a projection extending from said body transversely to said longitudinal axis, said projection being received within said recess.

27. The pistol according to claim 26, wherein said first strip is positioned on a first side of said body and said projection is positioned on a second side of said body opposite to said first.

28. The pistol according to claim 26, wherein said projection comprises a second strip extending outwardly from said body.

29. The pistol according to claim 28, wherein said second strip is curved.

30. The pistol according to claim 28, wherein said second strip has first and second ends attached to said body.

31. The pistol according to claim 26, wherein said projection is resiliently flexible.

32. The pistol according to claim 23, further comprising a metal plate positioned adjacent to said first strip, said metal plate comprising said surface engageable with said striker bushing.

33. The pistol according to claim 32, wherein said end cap further comprises:

a base, said first strip being mounted on said base;

a cover positioned in spaced relation to said base, said metal plate being positioned between said base and said cover.

* * * * *